US008576157B2

(12) United States Patent
Bae

(10) Patent No.: US 8,576,157 B2
(45) Date of Patent: Nov. 5, 2013

(54) LOW-POWER IMAGE DISPLAY DEVICE AND METHOD

(75) Inventor: Cheon Ho Bae, Seoul (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 778 days.

(21) Appl. No.: 12/232,361

(22) Filed: Sep. 16, 2008

(65) Prior Publication Data

US 2009/0115757 A1 May 7, 2009

(30) Foreign Application Priority Data

Sep. 17, 2007 (KR) ..... 10-2007-0094316

(51) Int. Cl.
*G09G 5/30* (2006.01)

(52) U.S. Cl.
USPC ..... 345/102; 345/617

(58) Field of Classification Search
USPC ..... 345/102, 690, 617
See application file for complete search history.

(56) References Cited

U.S. PATENT DOCUMENTS

| | | | | |
|---|---|---|---|---|
| 6,049,626 | A * | 4/2000 | Kim | 382/167 |
| 2005/0104842 | A1 | 5/2005 | Baik | |
| 2006/0208999 | A1 * | 9/2006 | Lee et al. | 345/102 |
| 2008/0239158 | A1 * | 10/2008 | Wu et al. | 348/677 |
| 2009/0052774 | A1 | 2/2009 | Yoshii et al. | |

FOREIGN PATENT DOCUMENTS

| | | | |
|---|---|---|---|
| CN | 1619629 A | 5/2005 | |
| GB | 2 408 138 | 5/2005 | |
| JP | 11055520 A * | 2/1999 | H04N 1/407 |
| JP | 11-65531 | 3/1999 | |
| KR | 10-2007-0041392 A | 4/2007 | |
| WO | WO 2006/103835 | 10/2006 | |

OTHER PUBLICATIONS

European Search Report issued in EP 08 16 4515, issued Dec. 29, 2009.

(Continued)

*Primary Examiner* — Allison Walthall
(74) *Attorney, Agent, or Firm* — NSIP Law

(57) ABSTRACT

Provided is a low-power image display device including a brightness determining unit that determines the brightness of image data applied from outside; a histogram analyzing unit that is connected to the brightness determining unit, calculates a cumulative distribution function (CDF) of the determined image data, and selects the brightness of the image data, corresponding to the number of pixels preset in the calculated CDF, as reference brightness; a brightness control unit that is connected to the brightness determining unit and the histogram analyzing unit and converts the image data such that the contrast of the image data is converted into contrast corresponding to the reference brightness; a data drive that is connected to the brightness control unit, receives the image data of which the contrast is changed, and converts the image data into an image output signal for displaying an image to the outside; a backlight control unit that is connected to the histogram analyzing unit and the data drive and generates a driving voltage for controlling the brightness of backlight to brightness corresponding to the reference brightness; and an image display unit that is connected to the data drive and the backlight control unit, receives the driving voltage generated from the backlight control unit and the image output signal, and displays an image by using the image data, of which the contrast is changed, and the backlight of which the brightness is changed.

26 Claims, 8 Drawing Sheets

(56) References Cited

OTHER PUBLICATIONS

Hanfeng Chen et al., "39.3: Locally Pixel-Compensated Backlight Dimming for Improving Static Contrast on LED Backlit LCD's", SID 2007, 2007 SID International Symposium, Society for Infomration Display, vol. 38, pp. 1339-1342, May 20, 2007.
Naehyuck Chang et al., "DLS: Dynamic Backlight Luminance Scaling of Liquid Crystal Display", IEEE Transactions on Very Large Scale Integration (VLSI) Systems, vol. 12, No. 8, pp. 837-846, Aug. 2004.
Chinese Notification of the first office action issued Nov. 1, 2011, in counterpart Chinese application No. 200810211533.9 (16pp, including an English translation).
Japanese Office Action issued Jul. 24, 2012 in counterpart Japanese Patent Application No. 2008-238454 (3 pages, in Japanese).

* cited by examiner

FIG. 1 [Related Art]

LOW-POWER IMAGE DISPLAY DEVICE AND METHOD

CROSS-REFERENCE TO RELATED APPLICATIONS

This application claims the benefit of Korean Patent Application No. 10-2007-0094316 filed with the Korea Intellectual Property Office on Nov. 17, 2007, the disclosure of which is incorporated herein by reference.

BACKGROUND OF THE INVENTION

1. Field of the Invention

The following description relates to a low-power image display device and method.

2. Description of the Related Art

In general, image display devices serve to display image data, applied from a camera or imaging device, in a state of visible light which can be seen by people. Televisions or beam projectors belong to the image display devices. Recently, with the development of technology, researches on image display devices using LCD (Liquid Crystal Display) or PDP (Plasma Display Panel) are actively carried out.

In particular, since the LCD cannot emit light by itself, an image display device using the LCD requires a separate light source for LCD. As for the light source for LCD, a CCFL (Cold Cathode Fluorescent Lamp) is mainly used. In terms of characteristics of the CCFL, the brightness and lifespan thereof are inversely proportional to each other. That is, when the CCFL is driven by a high current so as to increase the brightness, the lifespan is reduced. On the contrary, to increase the lifespan, the CCFL should be driven by a low current. Therefore, it is difficult to achieve high brightness. In most cases, however, high brightness and a long lifespan are simultaneously requested, when the CCFL is applied to products.

Hereinafter, a conventional image display device using the LCD panel will be described with reference to accompanying drawings.

FIG. 1 is a block diagram of a conventional image display device.

As shown in FIG. 1, the conventional image display device includes an image display unit 110, a backlight driving unit 120, and a data drive 130.

The image display unit 110 is composed of an image display panel 111 and a backlight module 112 and is connected to the backlight driving unit 120 and the data drive 130. The image display unit 110 outputs image output data D, applied through the data drive 130, through the image display panel 111.

The backlight driving unit 120 generates a driving voltage C for driving the backlight module 112 so as to supply to the backlight module 112. The backlight module 112 is driven by the driving voltage C supplied from the backlight driving unit 120 so as to supply light to the image display panel 111 while maintaining constant brightness.

The data drive 130 delivers to the image display panel 111 the image output data D which is converted into data for outputting RGB image data applied from outside through the image display panel 111.

That is, to output the RGB image data, applied from outside, as visible light which can be seen by people, the image output data D converted by the data drive 130 is delivered to the image display panel 111. Further, to supply auxiliary light to the image display panel 111 which cannot emit light, the driving voltage C supplied through the backlight driving unit 120 is supplied to the backlight module 112 such that the RGB image data is displayed on the image display panel 111.

However, the conventional image display device has the following problems.

In the conventional image display device, a technique for high brightness and long-term lifespan is adopted, in which when an image should be displayed with high brightness or an external input is received from a user while the backlight module 112 is driven so as to display an image on the image display panel 111 with preset brightness, a high current is temporarily applied to the backlight module 112 such that an active region of the image display panel 111 with respect to the brightness is widened.

Further, when the image display panel 111 is used as the LCD, an amount of current used in the image display panel 111 differs depending on an image displayed on the image display panel 111. That is, in a case of the normally-white mode where liquid crystal molecules within the image display panel 111 are re-arranged in an electric-field direction with the application of voltage to the image display panel 111 such that incident light is cut off, the power consumption of the image display panel 111 is reduced, as the number of bright pixels increases in the image display panel 111. However, as the number of dark pixels increases, the power consumption of the image display unit 110 is increased.

To solve such a problem, a method is used in which a current value of the driving voltage C of the backlight module 112 interlocked with the image display panel 111 is controlled depending on the power consumption of the image display panel 111. When such a method is applied, an additional circuit should be implemented in such a manner that the conventional image display device fits into a variable range for controlling the brightness of the backlight driving unit 120 which detects the current consumed by the image display panel 111 and drives the backlight module 112.

Further, since all the images are controlled with the same brightness, power consumption increases in comparison with when the brightness should be controlled only for an image where the brightness control is required. As the brightness is adjusted, a brighter or darker image than an intended image may be output. Then, reliability of the image is degraded.

SUMMARY OF THE INVENTION

A general aspect may provide a low-power image display device and method, in which the contrast of image data output to the image display device and the brightness of backlight are simultaneously adjusted to output an image such that power consumption of a backlight module can be reduced and an image can be displayed clearly.

According to a general aspect, a low-power image display device includes a brightness determining unit that determines the brightness of image data applied from outside; a histogram analyzing unit that is connected to the brightness determining unit, calculates a cumulative distribution function (CDF) of the determined image data, and selects the brightness of the image data, corresponding to the number of pixels preset in the calculated CDF, as reference brightness; a brightness control unit that is connected to the brightness determining unit and the histogram analyzing unit and converts the image data such that the contrast of the image data is converted into contrast corresponding to the reference brightness; a data drive that is connected to the brightness control unit, receives the image data of which the contrast is changed, and converts the image data into an image output signal for displaying an image to the outside; a backlight control unit that is connected to the histogram analyzing unit and the data drive and generates a driving voltage for controlling the brightness of backlight to brightness corresponding to the reference brightness; and an image display unit that is connected to the data drive and the backlight control unit, receives the driving voltage generated from the backlight control unit and the image output signal, and displays an image by using the image data, of which the contrast is changed, and the backlight of which the brightness is changed.

The general aspect of the low-power image display device may further provide that the reference brightness in the histogram analyzing unit is brightness corresponding to the number of pixels of image data in the range of 80 to 90% of the maximum value of the CDF. The histogram analyzing unit divides the brightness of the image data into a plurality of regions.

The general aspect of the low-power image display device may further provide that, in each of the regions, a first weight which is applied to a pixel of image data having lower brightness than the reference brightness and a second weight which is applied to a pixel of image data having higher brightness than the reference brightness are previously set. When each pixel of the applied image data has lower brightness than that of a black conversion point where the brightness of the image data is preset to low brightness, the brightness control unit outputs the pixel as it is, without converting the contrast of the pixel.

The general aspect of the low-power image display device may further provide that, when the brightness of the applied pixel is higher than that of the black conversion point and is lower than the reference brightness, the brightness control unit multiplies the pixel by the first weight of a region to which the reference brightness belongs, thereby converting the contrast of the pixel. When the brightness of the applied pixel is higher than the reference brightness, the brightness control unit multiplies the pixel by the second weight of a region to which the reference brightness belongs, thereby converting the contrast of the pixel.

The general aspect of the low-power image display device may further provide that, the brightness control unit adds an offset value preset by a user to the pixel multiplied by the second weight, thereby converting the contrast of the pixel. When the reference brightness belongs to the region having the highest brightness among the plurality of regions and 40% of total pixels of the image data have lower brightness than the middle brightness of the highest brightness in the CDF, the brightness control unit outputs the image data at it is, without converting the contrast of the image data.

The general aspect of the image display device may further provide that the backlight control unit controls the brightness of the backlight to brightness corresponding to a region to which the reference brightness of the image data belongs. The backlight control unit controls the driving voltage through any one selected from PWM (Pulse Width Modulation), PAM (Pulse Amplitude Modulation), and PFM (Pulse Frequency Modulation) control methods.

According to another general aspect, an image display method includes the steps of: (a) determining the brightness of image data applied from outside; (b) calculating a CDF of the image data through the determined brightness, and selecting reference brightness of the image data; (c) converting the contrast of the image data into contrast corresponding to the reference brightness; (d) generating a backlight driving voltage for controlling the brightness of backlight to brightness corresponding to the reference brightness; and (e) displaying an image to the outside by using the image data of which the contrast is changed and the backlight of which the brightness is changed.

The general aspect of the image display method may further provide that the reference brightness in step (b) is brightness corresponding to the number of pixels of image data in the range of 80 to 90% of the maximum value of the CDF, and the brightness of the image data is divided into a plurality of regions.

The general aspect of the image display method may further provide that, in each of the regions, a first weight which is applied to a pixel of image data having lower brightness than the reference brightness and a second weight which is applied to a pixel of image data having higher brightness than the reference brightness are previously set.

The general aspect of the image display method may further provide that (c) step includes the steps of: (c-1) judging whether or not a region to which the reference brightness belongs is a region having the maximum brightness among the plurality of regions; (c-2) when it is judged that the reference brightness does not belongs to the region having the maximum brightness, judging whether or not each pixel of the applied image data has higher brightness than that of a black conversion point where the brightness of the image data is preset to low brightness; (c-3) when it is judged that the brightness of the pixel is higher than that of the black conversion point, judging whether or not the brightness of the pixel is lower than the reference brightness; and (c-4) when it is judged that the brightness of the pixel is lower than the reference brightness, multiplying the pixel by the first weight of the region to which the reference brightness belongs, thereby applying contrast.

The general aspect of the image display method may further provide that, when it is judged in step (c-3) that the brightness of the pixel is lower than that of the black conversion point, the pixel is output as it is, without any conversion. When it is judged in step (c-4) that the brightness of the pixel is higher than the reference brightness, the pixel is multiplied by the second weight of the region to which the reference brightness belongs, and a preset offset value is added to the multiplication result such that contrast is applied.

The general aspect of the image display method may further provide that, when it is judged in step (c-2) that the reference brightness belongs to the region having the maximum brightness, step (c-2) includes the steps of: (c-21) judging whether or not 40% of total pixels of the image data have higher brightness than the middle brightness-of the maximum brightness; (c-22) when it is judged that 40% of total pixels of the image data have higher brightness than the middle brightness of the maximum brightness, judging whether or not the brightness of each pixel of the applied image data is higher than that of the black conversion point; (c-23) when it is judged that the brightness of the pixel is higher than that of the black conversion point, judging that the brightness of the pixel is higher than the reference brightness; and (c-24) when it is judged that the brightness of the pixel is lower than the reference brightness, multiplying the pixel by the first weight of the region having the maximum brightness, thereby applying contrast.

The general aspect of the image display method may further provide that, when it is judged in step (c-22) that 40% of total pixels of the image data have lower brightness than the middle brightness of the maximum brightness, the applied image data is output as it is, without any conversion. When it is judged in step (c-23) that the brightness of the pixel is lower than that of the black conversion point, the applied pixel is output as it is, without any conversion.

The general aspect of the image display method may further provide that, when it is judged in step (c-24) that the brightness of the pixel is higher than the reference brightness, the pixel is multiplied by the second weight of the region having the maximum brightness, and a preset offset value is added to the multiplication result such that contrast is applied.

The general aspect of the image display method may further provide that the brightness corresponding to the reference brightness in step (d) is backlight brightness of the region to which the reference brightness of the image data belongs. Further, the backlight driving voltage in step (d) is controlled by any one selected from PWM, PAM, and PFM control methods.

Other features and aspects may be apparent from the following detailed description, the drawings, and the claims.

DETAILED DESCRIPTION

Figure 1:
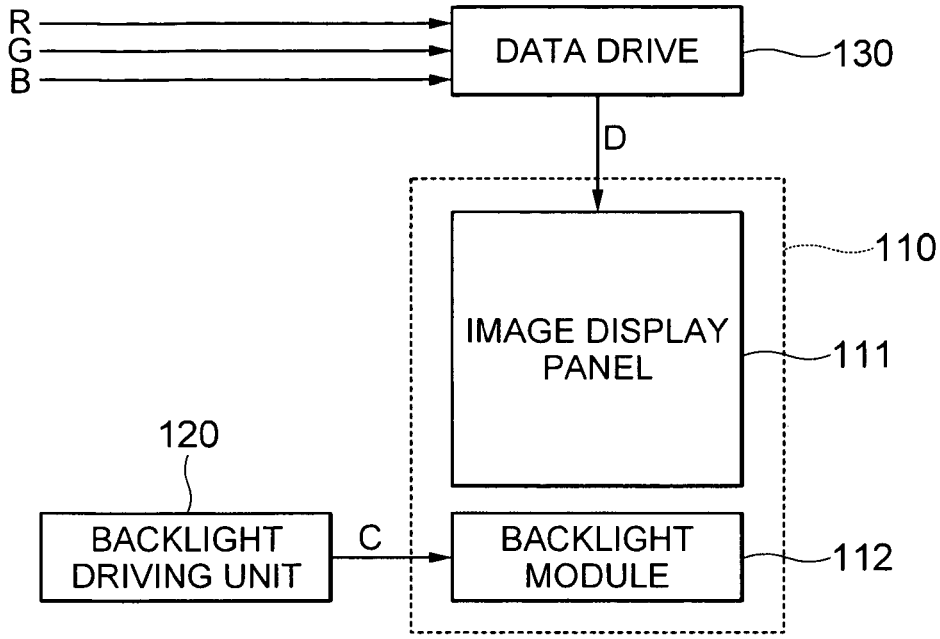
FIG. 1 is a block diagram of a conventional image display device.

Reference will now be made in detail to examples of general aspects illustrated in the accompanying drawings, where like reference numerals refer to like elements throughout. Examples are described below in order to explain general aspects by referring to the figures.

Low-Power Image Display Device

Hereinafter, an example of a low-power image display device according to a general aspect will be described in detail with reference to the accompanying drawings.

Figure 2:
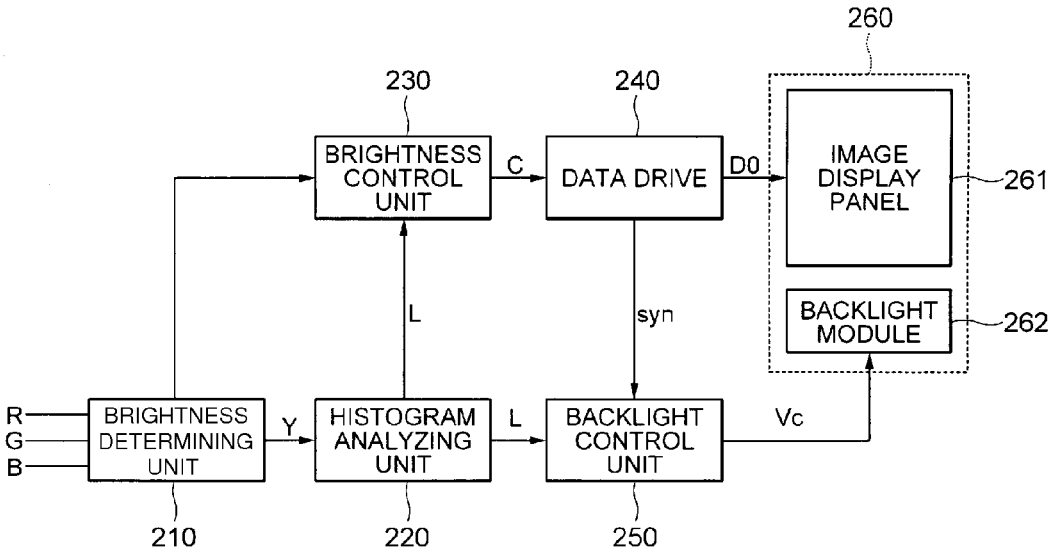
FIG. 2 is a block diagram illustrating an example of a low-power image display device according to a general aspect.
Figure 3:
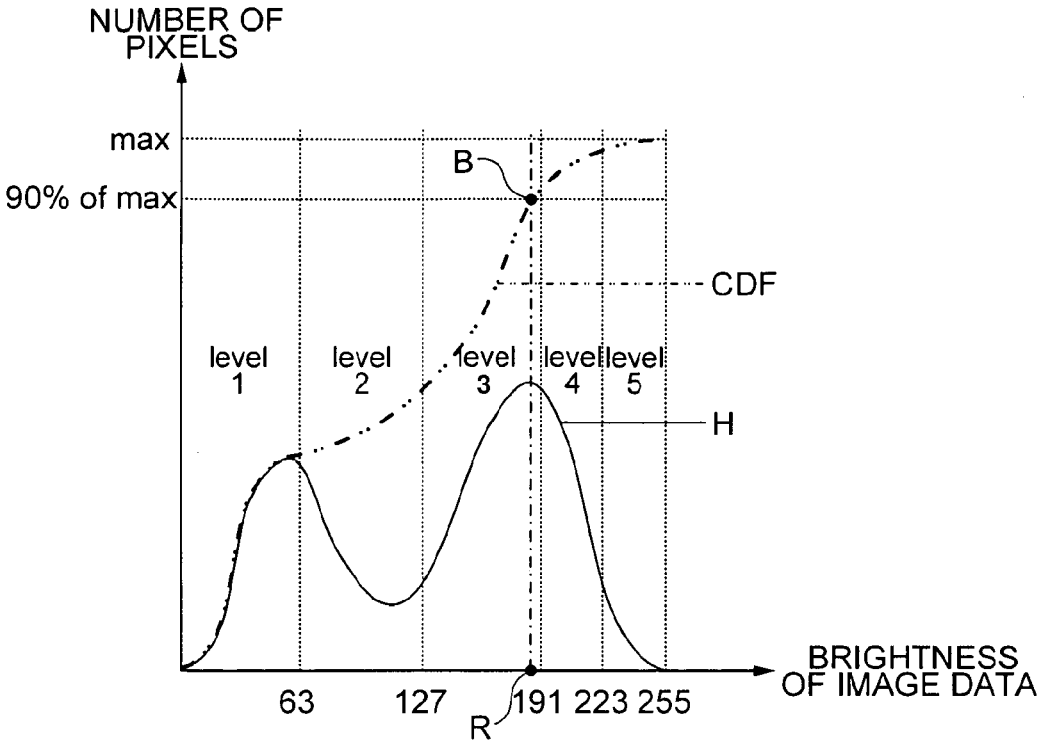
FIG. 3 is a graph illustrating an example that shows a cumulative distribution function (CDF) of pixels and the brightness of the low-power image display device according to a general aspect.

FIG. 2 is a block diagram illustrating an example of a low-power image display device according to a general aspect. FIG. 3 is a graph illustrating an example that shows a cumulative distribution function (CDF) of pixels and the brightness of the low-power image display device according to a general aspect. FIGS. 4, 5A to 5D are graphs illustrating examples that show first and second weights which are applied in accordance with reference brightness of the low-power image display device according to a general aspect.

As shown in FIG. 2, an example of the low-power image display device according to a general aspect includes a brightness determining unit 210, a histogram analyzing unit 220, a brightness control unit 230, a data drive 240, a backlight control unit 250, and an image display unit 260. The low-power image display device converts RGB image data applied from outside, and displays the RGB data on the image display unit 260 by using visual light which can be seen by people.

The brightness determining unit 210 is connected to the histogram analyzing unit 220 and the brightness control unit 230 and determines the brightness Y of RGB image data, applied from outside, to deliver to the histogram analyzing unit 220. Further, the brightness determining unit 210 delivers the RGB image data to the brightness control unit 230.

The histogram analyzing unit 220 is connected to the brightness determining unit 210, the brightness control unit 230, and the backlight control unit 250. As shown in FIG. 3, the histogram analyzing unit 220 calculates histograms H and a CDF of the RGB image data by using the brightness Y determined by the brightness determining unit 210. The CDF is a graph obtained by accumulating the histograms H depending on brightness. Further, the histogram analyzing unit 220 selects brightness corresponding to the number of pixels preset in the CDF as the reference brightness R of the RGB data by using the calculated CDF.

When the reference brightness R of the RGB image data is selected by the histogram analyzing unit 220, brightness corresponding to the number of pixels of the RGB image data when the CDF approaches 90% of the maximum value thereof, that is, brightness corresponding to a position of '90% of max' in FIG. 3 is selected as the reference brightness R. At this time, although the number of pixels of the RGB image data corresponding to 90% of the maximum value of the CDF is selected as the reference brightness R, the reference brightness R is not limited to 90% of the maximum value of the CDF, but may be set in the range of 80 to 90% depending on users.

The histogram analyzing unit 220 divides the brightness (0-255) of the RGB image data into a plurality of regions. In a general aspect, the brightness is divided into first to five regions. In this case, the first region (level 1) ranges from 0 to 63, the second region (level 2) ranges from 64 to 127, the third region (level 3) ranges from 128 to 191, the fourth region (level 4) ranges from 192 to 223, and the fifth region (level 5) ranges from 224 to 255. The reason why the histogram analyzing unit 220 divides the brightness of the RGB image data into the plurality of regions is as follows. Since the reference brightness R of the RGB image data corresponds to 90% of the brightness of the RGB image data, the reference brightness R may be a standard for displaying the RGB image data. Therefore, a ratio of contrast applied to the RGB image data is differently set for each region, where the reference brightness R is positioned, so as to effectively apply the contrast of the RGB data. Then, an image is clearly converted.

As described above, the histogram analyzing unit 220 calculates the CDF for the RGB image data, selects the reference brightness R, and divides the brightness of the RGB image data into the first to fifth regions (levels 1 to 5). Then, the histogram analyzing unit 220 delivers a position signal L to the brightness control unit 230 and the backlight control unit 250, respectively, the position signal L indicating to which region a reference point B of the CDF corresponding to the reference brightness R belongs.

The brightness control unit 230 is connected to the brightness determining unit 210, the histogram analyzing unit 220, and the data drive 240. The brightness control unit 230 applies a weight of contrast depending on the position signal L so as to convert the contrast of the RGB image data, applied from the brightness determining unit 210, into contrast corresponding to the reference brightness R.

Figure 4:
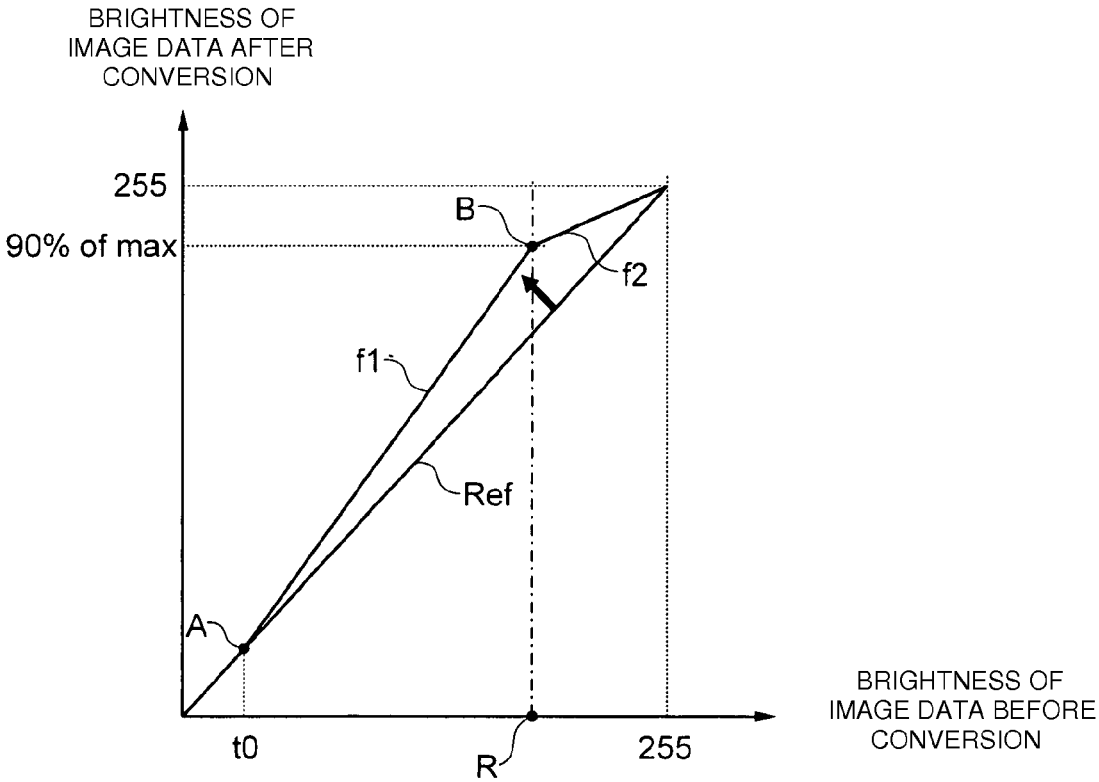
FIGS. 4, 5A to 5D are graphs illustrating examples that show first and second weights which are applied in accordance with reference brightness of the low-power image display device according to a general aspect.

At this time, when the brightness of the RGB image data is equal to or lower than predetermined brightness, the brightness control unit 230 judges that changing contrast is to reduce the sharpness of an image. Then, the brightness control unit 230 selects a black conversion point A serving as a reference point at which the RGB image data is output as it is. The black conversion point A is a position which has low brightness. As shown in FIG. 4, the black conversion point A corresponds to brightness t0 included in the first region (level 1).

The brightness control unit 230 checks that the position signal L applied from the histogram analyzing unit 220 indicates to which region of the first to fifth regions (levels 1 to 5) the reference brightness R belongs. That is, when the position signal L is a signal indicating that the reference brightness R belongs to the first region (level 1), the brightness control unit 230 uses the graph of FIG. 5A. When the position signal L is a signal indicating that the reference brightness R belongs to the second region (level 2), the brightness control unit 230 uses the graph of FIG. 5B. When the position signal L is a signal indicating that the reference brightness R belongs to the third region (level 3), the brightness control unit 230 uses the graph of FIG. 5C. When the position signal L is a signal indicating that the reference brightness R belongs to the fourth region (level 4), the brightness control unit 230 uses the graph of FIG. 5D.

Further, the brightness control unit 230 applies a different weight to the brightness of the respective pixels composing the RGB image data on the basis of the brightness t0 of the black conversion point A and the reference brightness R, thereby converting the contrast of the pixels.

Figure 5A:
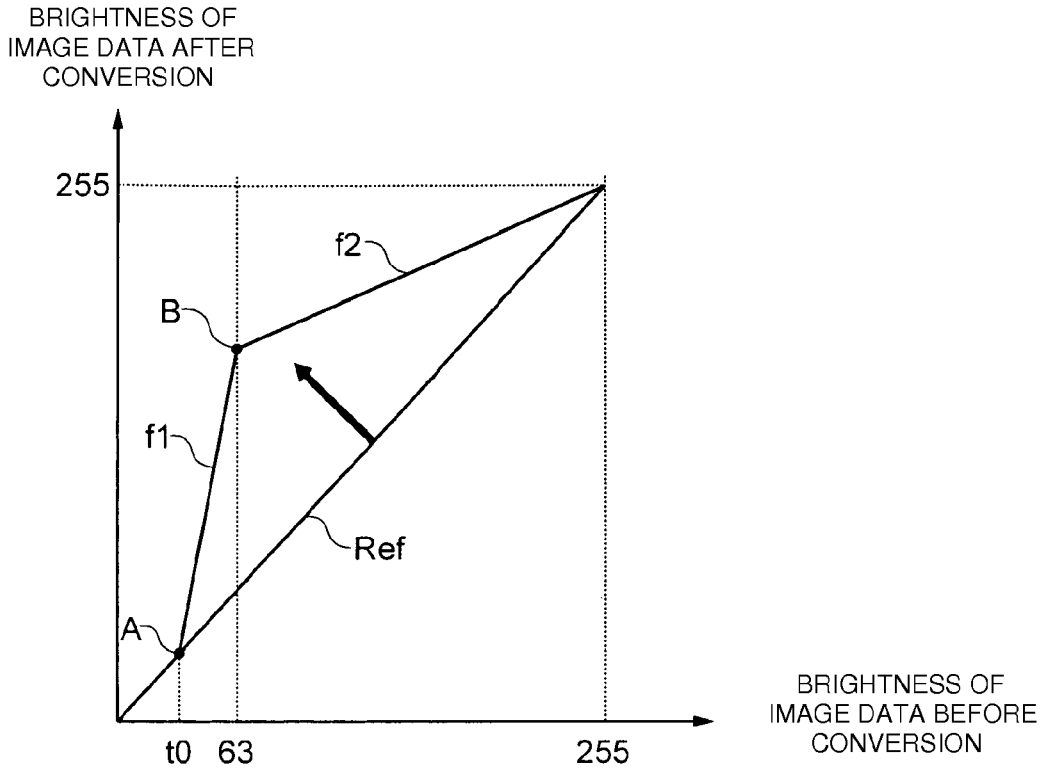
Figure 5B:
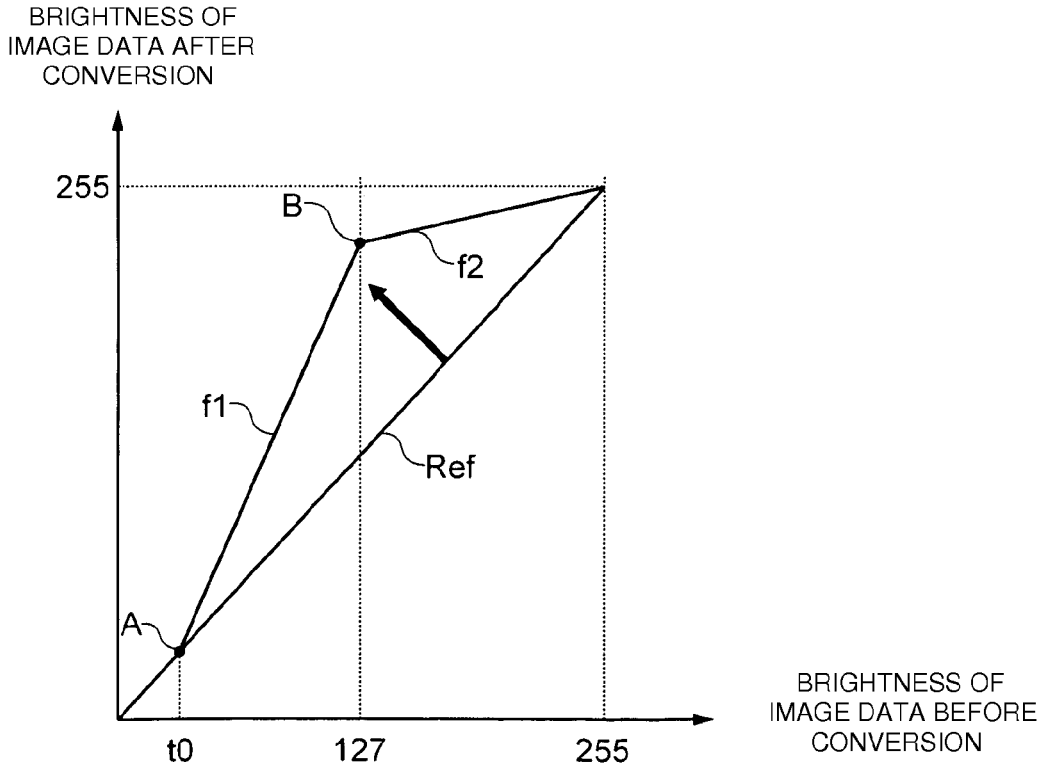
Figure 5C:
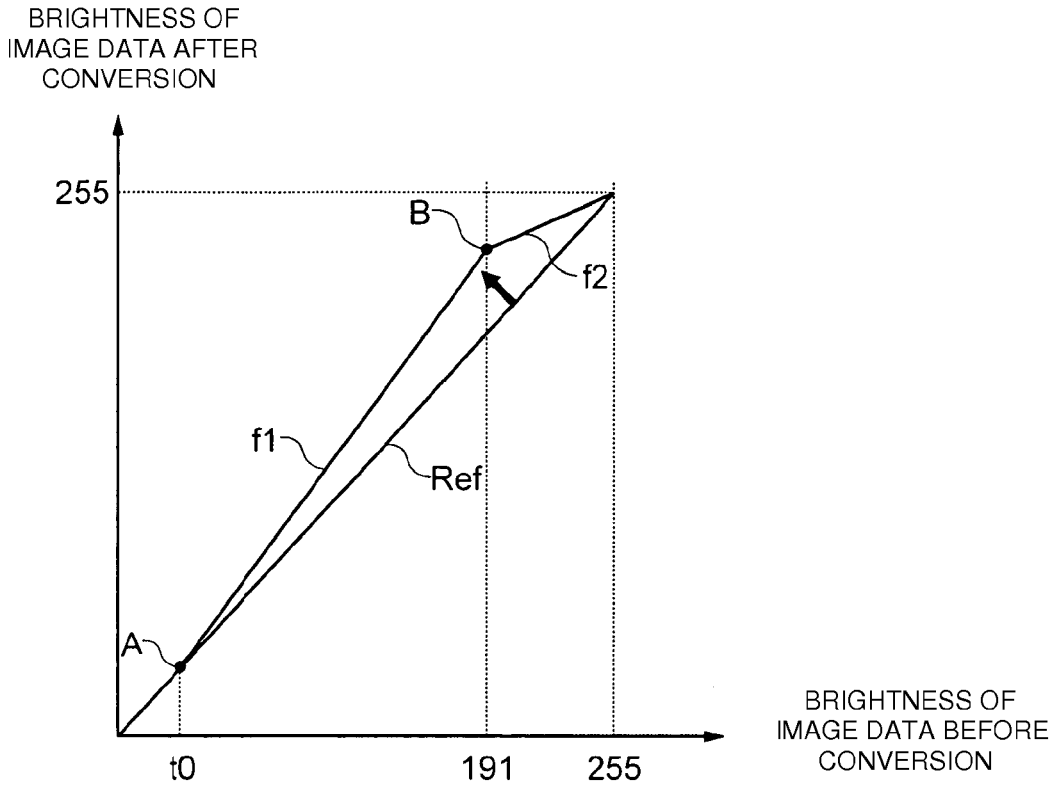
Figure 5D:
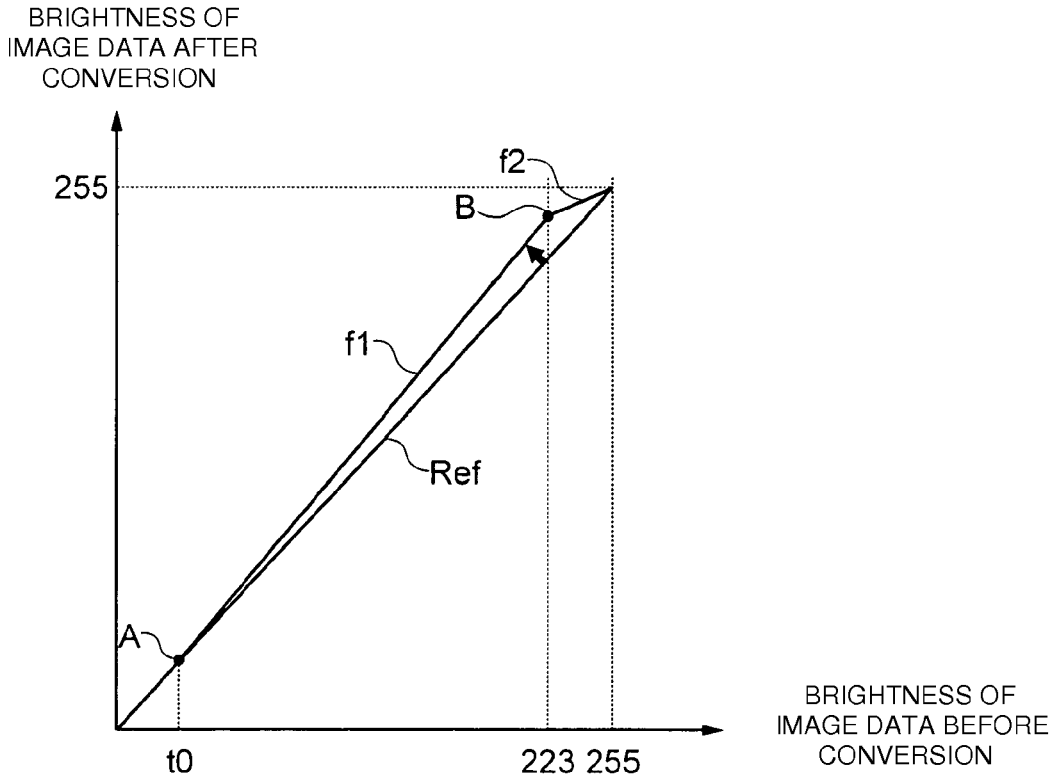

For example, when the position signal L applied from the histogram analyzing unit 220 is a signal indicating that the reference brightness R belongs to the first region (level 1), the brightness control unit 230 uses the graph of FIG. 5A. When a pixel which is firstly applied among the pixels of the RGB image data has lower brightness than that (t0) of the black conversion point A, the brightness control unit 230 outputs the applied pixel, without converting the contrast of the pixel. Further, when a pixel which is subsequently applied has higher brightness than that (t0) of the black conversion point A and lower brightness than the reference brightness R, the brightness control unit 230 multiplies the pixel by a first weight of 1.1875 corresponding to the first region of Table 1. Furthermore, when a pixel which is subsequently applied has higher brightness than the reference brightness R, the brightness control unit 230 multiplies the pixel by a second weight of 1 corresponding to the first region of Table 1, and then applies contrast by adding an offset value preset by a user to the multiplication result.

TABLE 1

| Position of reference brightness | First weight | Second weight |
|---|---|---|
| Fifth region | 1 | 1 |
| Fourth region | 1.0625 | 0.5 |
| Third region | 1.125 | 0.5 |
| Second region | 1.15625 | 0.75 |
| First region | 1.1875 | 1 |

When the position signal L is a signal indicating that the reference brightness R belongs to each of the second to fourth regions (levels 2 to 4), the brightness control unit 230 multiplies each pixel by the first or second weight of the region in the same manner as in the first region (level 1), thereby applying contrast to the pixel of the RGB image data.

If the position signal L is a signal indicating that the reference brightness R belongs to the fifth region (level 5), the brightness control unit 230 judges whether or not 40% of total pixels of the RGB data have higher brightness than 127 which is the middle brightness of the maximum brightness. If 40% of total pixels have lower brightness than 127, the brightness control unit 230 outputs the RGB image data without applying contrast to the RGB image data.

Meanwhile, when 40% of total pixels of the RGB image data has higher brightness than 127, the brightness control unit 230 converts the RGB image data in the same manner as in the applying of the contrast to the RGB data when the reference brightness R belongs to each of the first to fourth regions (levels 1 to 4).

Through the above-described method, the brightness control unit 230 applies contrast to the respective pixels of the RGB image data, thereby the sharpness of an image.

The data drive 240 is connected to the brightness control unit 230, the backlight control unit 250, and the image display unit 260. The data drive 240 receives the RGB image data, to which the contrast is applied, from the brightness control unit 230 and converts the RGB image data into an image output signal D0 to deliver to the image display unit 260, the image output signal D0 being a signal for displaying the RGB image data as an image to the outside. Further, the data drive 240 delivers the RGB image data and a synchronization signal syn to the backlight control unit 250 so as to simultaneously implement backlight brightness corresponding to the RGB image data.

The backlight control unit 250 is connected to the histogram analyzing unit 220, the data drive 240, and the image display unit 260. The backlight control unit 250 receives the position signal L and generates a backlight driving voltage Vc for changing the brightness of backlight depending on the region to which the reference brightness R belongs, as shown in Table 2. Then, the backlight control unit 250 delivers the generated driving voltage Vc to the image display unit 260.

TABLE 2

| Position of reference brightness | Backlight brightness (%) |
|---|---|
| Fifth region | 100 |
| Fourth region | 93.75 |
| Third region | 87.5 |
| Second region | 84.375 |
| First region | 81.25 |

For example, when the position signal L is a signal indicating that the reference brightness R belongs to the first region (level 1), the backlight control unit 250 generates a backlight driving voltage Vc for emitting brightness corresponding to 81.25% of reference backlight brightness. Further, when the position signal L is a signal indicating that the reference brightness R belongs to the third region (level 3), the backlight control unit 250 generates a backlight driving voltage Vc for emitting brightness corresponding to 87.5% of the reference backlight brightness.

Further, when the image output signal D0 for the RGB image signal output to the data drive 240 is output, the backlight control unit 250 is driven by the synchronization signal syn applied from the data drive 240 so as to be synchronized with the data drive 240. Then, the backlight control unit 250 outputs a backlight driving voltage Vc for emitting corresponding brightness.

As for the control method for controlling the backlight driving voltage Vc, any one is selected from PWM (Pulse Width Modulation), PAM (Pulse Amplitude Modulation), and PFM (Pulse Frequency Modulation) control methods.

The image display unit 260 is composed of an image display panel 261 and a backlight module 262 and is connected to the data drive 240 and the backlight control unit 250. The image display panel 261 receives the image output signal D0 applied from the data drive 240 and displays the image output signal D0 to the outside, and the backlight module 262 receives the backlight driving voltage Vc supplied from the backlight control unit 250 and then provides backlight as auxiliary light to the image display panel 261 such that the image display unit 260 can display an image to the outside.

In the low-power image display device constructed in such a manner, the contrast of the RGB image data is adjusted by the brightness control unit 230, and the backlight driving voltage Vc is adjusted by the backlight control unit 250. Therefore, the power consumption of the backlight module 262, which consumes the largest amount of power, can be adjusted. Accordingly, it is possible to reduce the entire power consumption of the image display device.

Further, as the contrast of the RGB image data is changed by the brightness control unit 230, the sharpness of an image can be enhanced.

Image Display Method

Hereinafter, an image display method according to a general aspect will be described with reference to FIGS. 6 to 8.

Figure 6:
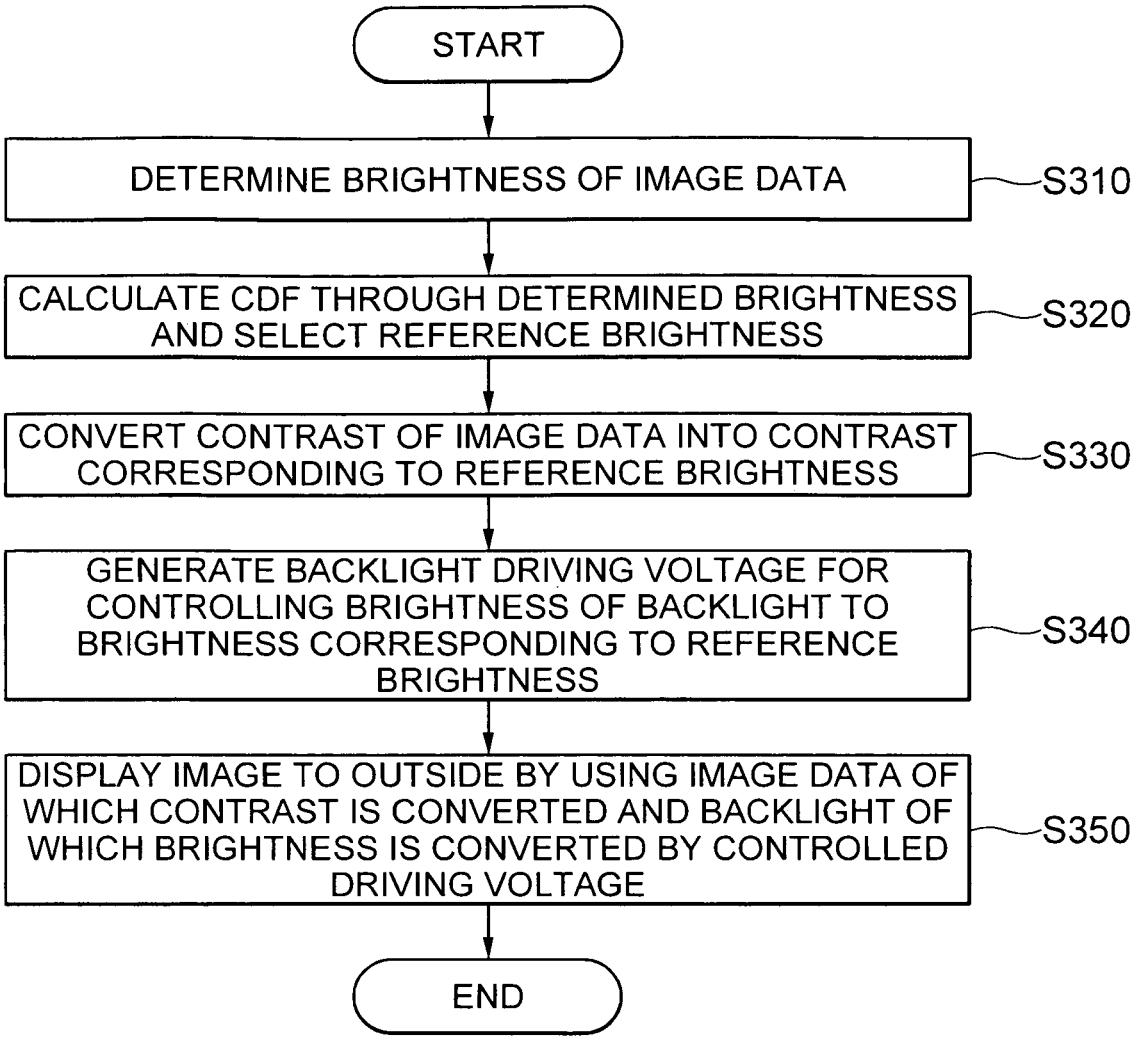
FIG. 6 is a flow chart illustrating an example that sequentially shows an image display method according to a general aspect.
Figure 7:
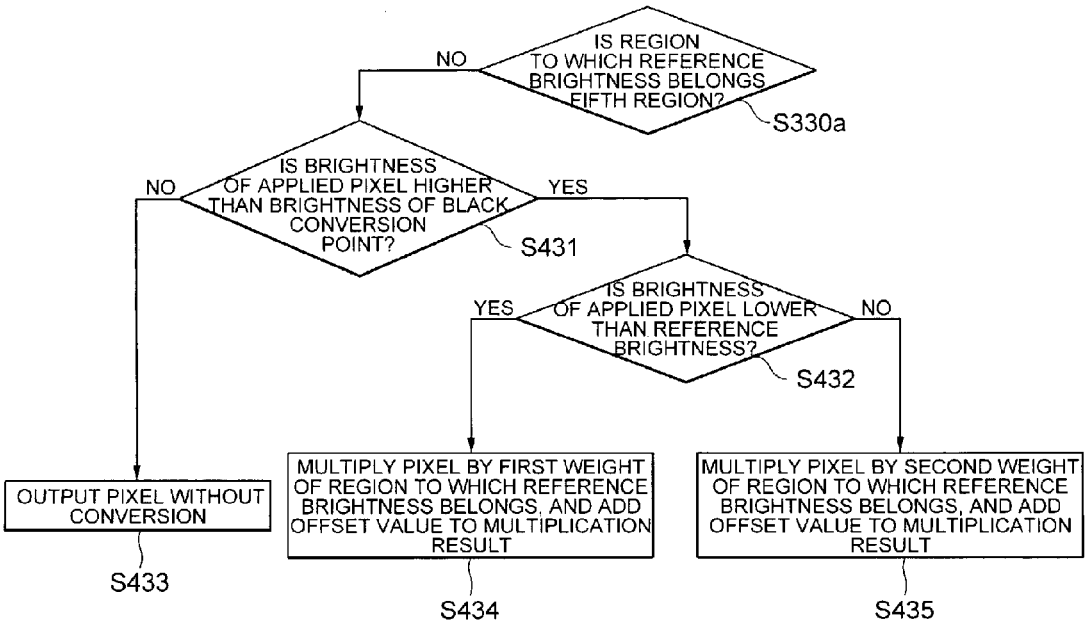
FIGS. 7 and 8 are flow charts illustrating examples that sequentially show a process of converting the contrast of image data in the image display method according to a general aspect.

FIG. 6 is a flow chart illustrating an example that sequentially shows an image display method according to a general aspect. FIGS. 7 and 8 are flow charts illustrating examples that sequentially show a process of converting the contrast of image data in the image display method according to a general aspect.

First, as shown in FIG. 6, the brightness of image data applied from outside is determined (step S310).

After the brightness of the image data is determined, a CDF is calculated through the determined brightness, and reference brightness is selected (step S320). At this time, the reference brightness in the step S320 is brightness corresponding to the number of pixels of the image data when the CDF approaches 90% of the maximum value thereof. Further, in step S320, the brightness of the image data is divided into first to fifth regions.

Then, it is judged to which region of the first to fifth regions the reference brightness selected in step S320 belongs, and the contrast of the image data is converted into the contrast of the corresponding region (step S330). At this time, step S330 is performed as follows. First, as shown in FIG. 7, it is judged whether or not the region to which the reference brightness belongs is the fifth region which is the brightest region among the first to fifth regions of the image data (step 330*a*).

When it is judged in step S330*a* that the region to which the reference brightness belongs is not the fifth region, it is judged whether or not each pixel of the applied image data has higher brightness than that of a black conversion point of which the brightness is preset to low brightness (step S431).

When it is judged in step S431 that the pixel of the applied image data has lower brightness than that of the black conversion point, contrast is not applied to the pixel of the applied image data, but the pixel is output as it is.

When it is judged in step S431 that the pixel of the applied image data has higher brightness than that of the black conversion point, it is judged whether or not the brightness of the applied pixel is lower than the reference brightness (step S432).

At this time, when it is judged in step S432 that the brightness of the applied pixel is lower than the reference brightness, the pixel is multiplied by a first weight of the region to which the reference brightness belongs such that contrast is applied to the pixel (step S434). Here, first and second weights are previously set as unique weights for changing the contrast of the image data for each of the first to fifth regions, as shown in Table 1. The first weight is applied to a pixel having lower brightness than the reference brightness, and the second weight is applied to a pixel having higher brightness than the reference brightness.

When it is judged in step S432 that the applied pixel has higher brightness than the reference brightness, the pixel is multiplied by a second weight of the region to which the reference brightness belongs. Then, an offset value preset by a user is added to the multiplication result such that contrast is applied to the pixel.

Figure 8:
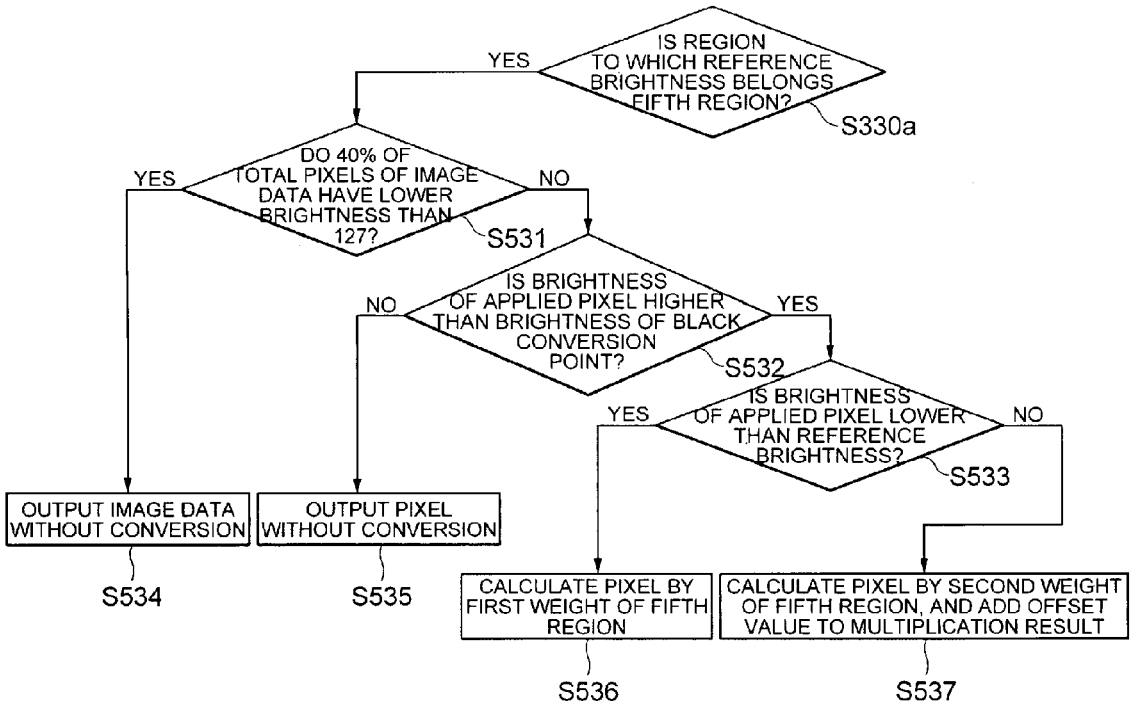

Further, as shown in FIG. 8, when it is judged in step S330*a* that the region to which the reference brightness belongs is the fifth region which has the highest brightness, it is judged whether or not 40% of total pixels of the image data have higher brightness than 127 which is the middle brightness of the maximum brightness of 255 (step S531).

When it is judged in step S531 that 40% of total pixels of the image data have lower brightness than 127, the image data is output without applying contrast to the image data (step S534).

At this time, when it is judged in step S531 that 40% of total pixels of the image data have higher brightness than 127, it is judged whether or not the applied pixel has higher brightness than that of the black conversion point (step S532).

When it is judged in step S532 that the applied pixel has lower brightness than that of the black conversion point, the pixel is output as it is, without applying contrast to the pixel (step S535).

Otherwise, when it is judged in step S532 that the applied pixel has higher brightness than that of the black conversion point, it is judged whether or not the pixel has higher brightness than the reference brightness (step S533).

When it is judged in step S533 that the applied pixel has lower brightness than the reference brightness, contrast is applied to the pixel by multiplying the pixel by the first weight of the fifth region, and the pixel is then output (step S536).

When it is judged in step 533 that the applied pixel has higher brightness than the reference brightness, the pixel is multiplied by the second weight of the fifth region, and an offset value preset by a user is added to the multiplication result such that contrast is applied to the pixel, and the pixel is then output (step S537).

In step S330 as described above, the brightness of the applied image data is determined, and a different weight is applied to the image data for each region so as to change the contrast, which makes it possible to enhance the sharpness of the image data.

After the contrast is applied to each pixel of the applied image data, a backlight driving voltage for controlling the brightness of backlight to brightness corresponding to the reference brightness is generated (step S340). As shown in Table 2, weights for controlling corresponding backlight brightness for each region, to which the reference brightness belongs, are previously set by a user.

As for the control method for controlling the backlight driving voltage, any one is selected from PWM, PAM, and PFM control methods.

Then, an image is displayed using the image data of which the contrast is changed in steps S330 and S340 and the backlight of which the brightness is changed by the controlled backlight driving voltage.

In the image display method, as the brightness of the backlight is adjusted depending on image data, a driving voltage for driving the backlight module, which consumes a larger amount of power, can be reduced. Further, the contrast of the image data is changed on the basis of the reference brightness, which makes it possible to enhance the sharpness of an output image.

According to teachings above, there is provided a method of simultaneously adjusting the contrast of image data output to the image display device and the brightness of backlight to output an image such that power consumption of a backlight module may be reduced and an image may be displayed clearly. Therefore, it is possible to enhance the reliability of the image.

A number of examples have been described above. Nevertheless, it will be understood by those skilled in the art that changes may be made. Accordingly, other implementations are within the scope of the following claims.

What is claimed is:

1. A low-power image display device, comprising:

a brightness determining unit configured to determine a brightness of image data applied from outside;

a histogram analyzing unit that is connected to the brightness determining unit, the histogram analyzing unit being configured to:

calculate a cumulative distribution function (CDF) of the applied image data through the determined brightness; and determine a reference brightness of the applied image data based on the calculated CDF, wherein the reference brightness is selected to be a brightness that corresponds to a calculated CDF value of a predetermined number of pixels;

a brightness control unit that is connected to the brightness determining unit and the histogram analyzing unit, the brightness control unit being configured to use the applied image data in converting a contrast of the applied image data into contrast corresponding to the reference brightness;

a data drive that is connected to the brightness control unit, the data drive being configured to:

receive the converted applied image data of which the contrast is changed; and convert the received applied image data into an image output signal to display an image to the outside;

a backlight control unit connected to the histogram analyzing unit and the data drive and driven by a synchronization signal applied from the data drive, the backlight control unit being configured to:

generate a driving voltage to control a brightness of backlight to a brightness corresponding to the reference brightness; and output the generated driving voltage in synchronization with an outputting of the image output signal by the data drive according to the synchronization signal;

an image display unit that is connected to the data drive and the backlight control unit, the image display unit being configured to:

receive the generated driving voltage from the backlight control unit and the image output signal; and display an image by using:

the image output signal, of which the contrast is changed; and the generated driving voltage to control the brightness of the backlight.

2. The low-power image display device according to claim 1, wherein the reference brightness corresponds to pixels of the applied image data in a range of 80 to 90% of a maximum value of the calculated CDF.

3. The low-power image display device according to claim 1, wherein the histogram analyzing unit is further configured to divide the brightness of the applied image data into a plurality of regions.

4. The low-power image display device according to claim 3, wherein a first weight, which is applied to one of the number of pixels of the applied image data having a brightness that is less than the reference brightness, and a second weight, which is applied to one of the number of pixels of the applied image data having a brightness that is greater than the reference brightness, are previously set in each of the regions.

5. The low-power image display device according to claim 4, wherein, when each of the pixels of the applied image data has a brightness that is less than a brightness of a black conversion point where the brightness of the applied image data is preset to low brightness, the brightness control unit outputs each of the pixels as it is, without converting a contrast of each of the pixels.

6. The low-power image display device according to claim 5, wherein, when the one of the number of pixels having the brightness that is less than the reference brightness has a brightness that is greater than the brightness of the black conversion point, the brightness control unit multiplies the one of the number of pixels having the brightness that is less than the reference brightness by the first weight of a region to which the reference brightness belongs, thereby converting a contrast of the one of the number of pixels having the brightness that is less than the reference brightness.

7. The low-power image display device according to claim 5, wherein the brightness control unit multiplies the one of the number of pixels having the brightness that is greater than the reference brightness by the second weight of a region to which the reference brightness belongs, thereby converting a contrast of the one of the number of pixels having the brightness that is greater than the reference brightness.

8. The low-power image display device according to claim 7, wherein the brightness control unit adds an offset value preset by a user to the multiplied one of the number of pixels having the brightness that is greater than the reference brightness, thereby converting the contrast of the one of the number of pixels having the brightness that is greater than the reference brightness.

9. The low-power image display device according to claim 5, wherein, when the reference brightness belongs to one of the regions having a maximum brightness among the plurality of regions and 40% of the number of pixels of the applied image data have a brightness that is less than a midpoint of the highest brightness in the CDF, the brightness control unit outputs the applied image data as it is, without converting the contrast of the applied image data.

10. The low-power image display device according to claim 3, wherein the backlight control unit controls the brightness of the backlight to a brightness corresponding to one of the regions to which the reference brightness of the applied image data belongs.

11. The low-power image display device according to claim 10, wherein the backlight control unit controls the driving voltage through one of PWM (Pulse Width Modulation), PAM (Pulse Amplitude Modulation), and PFM (Pulse Frequency Modulation) control methods.

12. The low-power image display device according to claim 1, wherein the histogram analyzing unit is further configured to divide the brightness of the applied image data into a plurality of regions; and a ratio of contrast applied to the applied image data depends on the region where the reference brightness is positioned.

13. An image display method, comprising:

determining a brightness of image data applied from outside;

calculating a cumulative distribution function (CDF) of the applied image data through the determined brightness;

determining a reference brightness of the applied image data based on the calculated CDF, wherein the reference brightness is selected to be a brightness that corresponds to a calculated CDF value of a predetermined number of pixels;

using the applied image data in converting a contrast of the applied image data into contrast corresponding to the reference brightness;

converting the applied image data of which the contrast is converted into an image output signal to display an image to the outside;

generating a backlight driving voltage to control a brightness of backlight to a brightness corresponding to the reference brightness;

outputting the generated backlight driving voltage in synchronization with an outputting of the image output signal according to a synchronization signal that is driving the outputting of the generated backlight driving voltage; and displaying an image to the outside by using the image output signal and the backlight driving voltage that are synchronously outputted.

14. The image display method according to claim 13, wherein the reference brightness corresponds to the number of pixels of the applied image data in a range of 80 to 90% of a maximum value of the calculated CDF.

15. The image display method according to claim 13, wherein the calculating of the CDF comprises dividing the brightness of the applied image data into a plurality of regions.

16. The image display method according to claim 15, wherein a first weight, which is applied to one of the number of pixels of the applied image data having a brightness that is less than the reference brightness, and a second weight, which is applied to one of the number of pixels of the applied image data having brightness that is greater than the reference brightness, are previously set in each of the regions.

17. The image display method according to claim 16, wherein the converting of the contrast comprises:

judging whether the reference brightness belongs to one of the regions having a maximum brightness among the plurality of regions;

if the reference brightness is judged not to belong to the one of the regions having the maximum brightness, judging whether each of the pixels of the applied image data has a brightness that is greater than a brightness of a black conversion point where the brightness of the applied image data is preset to low brightness;

if the brightness of each of the pixels is judged to be greater than the brightness of the black conversion point where the brightness of the applied image data is preset to low brightness, judging whether a brightness of one of the number of pixels is less than the reference brightness; and if the brightness of the one of the number of pixels is judged to be less than the reference brightness, multiplying the one of the number of pixels by the first weight of a region to which the reference brightness belongs, thereby applying contrast.

18. The image display method according to claim 17, wherein the converting of the contrast further comprises, if the brightness of each of the pixels is judged to be less than the brightness of the black conversion point where the brightness of the applied image data is preset to low brightness, outputting each of the pixels as it is, without any conversion.

19. The image display method according to claim 17, wherein the converting of the contrast further comprises, if the brightness of the one of the number of pixels is judged to be less than the reference brightness:

multiplying the one of the number of pixels by the second weight of the region to which the reference brightness belongs; and adding a preset offset value to a result of the multiplying of the one of the number of pixels by the second weight such that contrast is applied.

20. The image display method according to claim 17, wherein the converting of the contrast further comprises, if the reference brightness is judged to belong to the one of the regions having the maximum brightness:

judging whether 40% of the pixels of the applied image data have a brightness that is greater than a midpoint of the maximum brightness;

if 40% of the pixels of the applied image data are judged to have the brightness that is greater than the midpoint of the maximum brightness, judging whether the brightness of each of the pixels of the applied image data is greater than the brightness of the black conversion point;

if the brightness of each of the pixels of the applied image data is judged to be greater than the brightness of the black conversion point, judging whether a brightness of one of the number of pixels is less than the reference brightness; and if the brightness of the one of the number of pixels is judged to be less than the reference brightness, multiplying the one of the number of pixels by the first weight of a region to which the reference brightness belongs, thereby applying contrast.

21. The image display method according to claim 20, wherein the converting of the contrast further comprises, if the reference brightness is judged to belong to the one of the regions having the maximum brightness and if 40% of the pixels of the applied image data are judged to have a brightness that is less than the midpoint of the maximum brightness, outputting the applied image data as it is, without any conversion.

22. The image display method according to claim 20, wherein the converting of the contrast further comprises, if the reference brightness is judged to belong to the one of the regions having the maximum brightness and if the brightness of each of the pixels of the applied image data is judged to be less than the brightness of the black conversion point, outputting each of the pixels as it is, without any conversion.

23. The image display method according to claim 20, wherein the converting of the contrast further comprises, if the brightness of the one of the number of pixels is judged to be greater than the reference brightness:

multiplying the one of the number of pixels by the second weight of the region to which the reference brightness belongs; and adding a preset offset value to a result of the multiplying of the one of the number of pixels by the second weight such that contrast is applied.

24. The image display method according to claim 15, wherein the brightness corresponding to the reference brightness is backlight brightness of one of the regions to which the reference brightness of the applied image data belongs.

25. The image display method according to claim 13, further comprising controlling the backlight driving by one of PWM (Pulse Width Modulation), PAM (Pulse Amplitude Modulation), and PFM (Pulse Frequency Modulation) control methods.

26. The image display method according to claim 13, further comprising:

dividing the brightness of the applied image data into a plurality of regions, wherein a ratio of contrast applied to the applied image data depends on the region where the reference brightness is positioned.

* * * * *